United States Patent [19]

Price

[11] Patent Number: 4,468,150

[45] Date of Patent: Aug. 28, 1984

[54] ADJUSTABLE CRADLE FOR SUPPORTING AND STABILIZING BOATS

[76] Inventor: James W. Price, Rte. 1, Box 87, Grifton, N.C. 28530

[21] Appl. No.: 370,839

[22] Filed: Apr. 22, 1982

[51] Int. Cl.³ ..... B23Q 3/00; B63C 3/06; B63C 5/05; F16M 13/00

[52] U.S. Cl. ..... 405/7; 405/3; 114/44; 248/354.3; 269/296; 280/414.1

[58] Field of Search ..... 405/1, 3, 7; 248/170, 248/354.3; 280/414.1; 114/44–46, 344; 269/296

[56] References Cited

U.S. PATENT DOCUMENTS

| | | | |
|---|---|---|---|
| 1,950,413 | 3/1934 | Maxson | 405/1 |
| 3,045,839 | 7/1962 | Hibberd | 114/44 X |
| 3,131,902 | 5/1964 | Zak | 280/414.1 X |
| 3,139,277 | 6/1964 | Mears | 405/7 X |
| 3,554,394 | 1/1971 | Hedman | 280/414.1 X |
| 3,586,285 | 6/1971 | Modzelewski | 405/7 X |
| 3,756,439 | 9/1973 | Johnson | 280/414.1 X |
| 3,850,397 | 11/1974 | Kutchai | 248/354.3 |
| 4,155,667 | 5/1979 | Ebsen | 405/7 |

*Primary Examiner*—Cornelius J. Husar
*Assistant Examiner*—Nancy J. Stodola
*Attorney, Agent, or Firm*—Mills and Coats

[57] ABSTRACT

The present invention entails an adjustable boat cradle for supporting a boat. There is disclosed a rectangular base frame structure with a plurality of adjustable vertical support assemblies strategically located and connected to the base frame structure. Typically said vertical support assemblies extend generally upwardly from at least the corner areas of the base frame structure and includes an upper cradle pad that actually engages a side portion of the boat's hull while the keel of the boat is directly supported by an underlying support. To accommodate hulls of various sizes and shapes, the effective length and angle of orientation of the vertical support assemblies can be conveniently adjusted. In addition, the cradle pads are universally mounted about the vertical support assemblies such that they will rest adjacent the hull irrespective of the orientation of the support structure comprising the respective vertical support assemblies.

4 Claims, 4 Drawing Figures

ADJUSTABLE CRADLE FOR SUPPORTING AND STABILIZING BOATS

FIELD OF INVENTION

The present invention relates to boats and support systems for supporting boats and particularly sailboats out of the water, and more particularly to a boat cradle support system that is adjustable to accommodate variances in hull shapes in a single boat as well as boat hulls of various sizes and shapes.

BACKGROUND OF INVENTION

Cradle type boat support systems are known today. For example, the following U.S. Pat. Nos. indicate the general state of the art relative to boat support systems: 3,131,902; 3,139,277; 3,554,394; 3,586,285; 4,094,527 and 4,155,667.

Many cradle type boat support systems commercially available today and known have serious drawbacks and disadvantages. First, most cradle type boat support systems have at best limited utility as they are designed so as to be only compatible with a particular size and/or shape boat. In some cases where the cradle type boat support system is actually designed to accept boats of different sizes and shapes, the range that the support system will practically accommodate is often very narrow. Consequently these types of commercially available boat support cradle devices are especially unattractive to boat manufacturers, transporters, dealers and firms whose business relates to handling, supporting, or transporting boats out of water.

In addition some conventional boat cradle designs tend to be complicated, and that results in them being relatively expensive.

Finally some conventional cradle type boat support systems tend to occupy vast space and as such cannot be easily and efficiently stacked and shipped. In addition in the same regard, the nature of the design of some cradle type boat support systems makes them very difficult to handle.

SUMMARY OF INVENTION

The present invention presents a cradle type boat support system that is designed to overcome the disadvantages and drawbacks of conventional cradle type boat support systems known today. In particular the cradle type boat support system of the present invention is designed such that it is adjustable and flexible to the extent that it can accommodate most any size or shape boat hull. Consequently the cradle type boat support system of the present invention is not simply restricted to one or even a few different size and shape boat hulls.

In addition the cradle type boat support system of the present invention is designed to include a main rectangular frame structure with a plurality of vertical support assemblies wherein the respective vertical support assemblies can be folded down adjacent the main frame so as to provide a relatively compact structure for shipping and/or storage purposes. This allows for convenient storage when not in use and allows a substantial number of cradle support systems to be shipped and transported on a single trailer or load bed.

Finally the present design emphasizes functionability and simplicity. The design of the cradle type boat support system is such that the required structural size of the components comprising the respective vertical support assemblies are minimized. Obviously the net result of this is that the entire cradle type boat support system is relatively light and can be produced and sold relatively inexpensively.

It is, therefore, an object of the present invention to provide a cradle type boat support system for supporting a boat out of the water that is particularly designed to accommodate and be compatible with a wide range of hull shapes and sizes.

Still a further object of the present invention resides in the provision of a cradle type boat support system which includes movable vertical support assemblies that allow the same to be folded down adjacent a main or base frame structure for stacking, storage and convenient mass transport.

Still a further object of the present invention resides in the provision of a cradle type boat support system for supporting a sailboat or other type of boat wherein the design of such is inherently practical, reliable, durable and functional but which is relatively simple.

Another object of the present invention is to provide a cradle type boat support system of the character referred to above that directly supports the boat by supporting the keel of the boat and which generally stabilizes the boat through a series of adjustable vertical support assemblies that extend upwardly from a main or base frame structure and which engage selected bottom or side portions of the boat to prevent the same from tipping about one side and fore-and-aftly.

A further object of the present invention resides in the provision of a cradle type boat support system of the character referred to above that provides for easy and quick adjustment of the orientation of the respective vertical support assemblies such that the same can be disposed such that they extend relatively close to perpendicular to the area of contact with the boat hull in order to minimize side loads on the vertical support assembly.

Another object of the present invention resides in the provision of a cradle type boat support system of the basic character referred to above which includes a plurality of vertical support assemblies with the respective support assemblies being vertically adjustable to accommodate boats with varying keel depths.

Another object of the present invention is to provide a cradle type boat support system that is easy to set up and use and which enables a boat to be conveniently positioned thereon.

It also an object of the present invention to provide a cradle type boat support system that includes a main or base frame that is designed such that the same can be easily gripped and moved from a relatively flat surface.

A further object of the present invention is to provide a cradle type boat support system that is adapted to be utilized for a variety of purposes on different support surfaces such as a trailer or load bed.

Other objects and advantages of the present invention will become apparent from a study of the following description and the accompanying drawings which are merely illustrative of the present invention.

CRADLE TYPE BOAT SUPPORT SYSTEM

Figure 1:
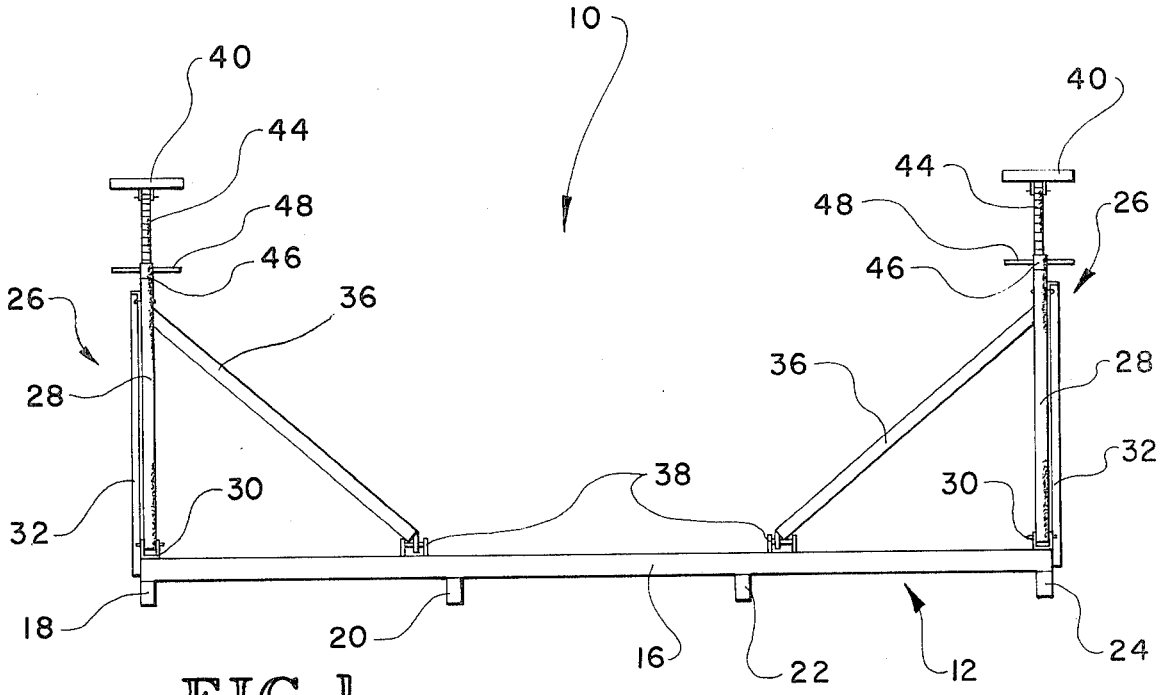
FIG. 1 is a side elevational view of the cradle type boat support system of the present invention with the system being disposed in an erect mode.

With further reference to the drawings, the cradle type boat support system is shown therein and indicated generally by the numeral 10.

Viewing cradle type boat support system 10 in detail, it is seen that the same includes a rectangular base or main frame structure that is preferably constructed of steel or other suitable means. Rectangular base frame structure 12 includes a pair of longitudinal members 14 and 16 joined by a series of transverse members 18, 20, 22 and 24. It is noted that transverse members 18, 20, 22 and 24 extend below the plane of the longitudinal members 14 and 16 so as to enable the entire base frame structure 12 to be easily gripped and moved without additional blocking or shimming.

Secured to the base frame structure 12 at selected strategic locations are a series of vertical support and/or stabilizing assemblies, indicated generally by the numeral 26. In a design such as illustrated in the drawings herein, the respective vertical support assemblies 26 are each disposed about a corner area of base frame structure 12. Vertical support assembly could be disposed at intermediate points between the corner areas, depending on the size of boat to be supported.

Viewing vertical support assemblies 26, it is seen that each includes a main support member 28 that is secured to said base frame structure 12 through a pivot mounting means 30. This allows main support member 28 to swing about the axis of a pin forming a part of the pivot mounting means 30. As viewed in FIG. 2, it is appreciated that the respective main support members 28 can swing laterally side to side.

To support and stabilize each main support member 28, there is provided lateral support means operatively interconnected between the main support member 28 and respective portions of base frame structure 12. In a contemplated design, the lateral stabilizing or support means referred to includes an end stabilizer 32, as particularly illustrated in FIG. 2. As will become apparent from subsequent portions of this disclosure, an important feature of the present invention is the adaptability of the respective vertical support assemblies 26 that enable the same to be moved relative to the base frame structure 12 in order to accommodate variances in hull size in a single boat as well as hulls of various size and shape. In this regard, attention is directed to the end-transverse members 18 and 24. In both cases these end-transverse frame members include a plurality of laterally spaced openings 34. This enables the lower ends of the end stabilizers 32 to be selectively positioned in these openings 34 to appropriately adjust the angle or orientation of main support member 28. Also, in this regard, the lateral stabilizing means in one embodiment further includes a side stabilizer 36 that is anchored through a pivot mounting assembly 38 to a respective longitudinal member 14 or 16 of the base frame structure 12. As particularly illustrated in FIGS. 1 and 3, these side stabilizer members 36 extend between the main or base frame structure 12 and the main support member 28 and tend to add fore-and-aft stability to the entire cradle type boat support system 10.

Secured about the upper portion of each vertical support assembly 26 is means for engaging and generally stabilizing the boat hull. In this regard, with particular reference to FIG. 4, it is seen that there is provided a cradle pad 40 that is operatively connected to the threaded shaft 44 through a universal connector 42. Cradle pad 40 is preferably padded such that the same does not scar nor scratch the boat being supported. Cradle pad 40 could be constructed of various components but it is contemplated that the same could be practically made of a wood block covered with a generally soft resilient covering such as carpet, rubber or the like.

It is further seen that universal connector 42 includes a yoke **42*a* and a pivot pin 42*b*. Since shaft 44 is threaded and can accordingly be axially adjusted, it follows that cradle pad 40** can be oriented and adjusted to rest flush adjacent a portion of the boat hull being engaged, stabilized and accordingly supported.

To adjust the effective height of the vertical support assemblies 26, there is provided a threaded nut disposed about the upper portion of each main support member 28 that is further provided with handle means 48. By appropriately rotating nut 46, it is appreciated that threaded shaft 44 can be caused to move axially up and down within a hollow opening formed within main support member 28. It follows then by appropriately adjusting the screw mechanism 46 that the effective height or length of the main support member 28 can be appropriately adjusted.

In the design of the cradle boat support system 10 of the present invention, it is contemplated that the main or principal support for supporting a boat will be effectuated through a keel support that is shown in the drawings and referred to therein by the numeral 50. Keel support 50 can simply be an appropriate member, such as a wood board for example, that is placed longitudinally over the base frame structure 12 and supported thereat by a number of the transverse frame members 20 and 22.

Figure 2:
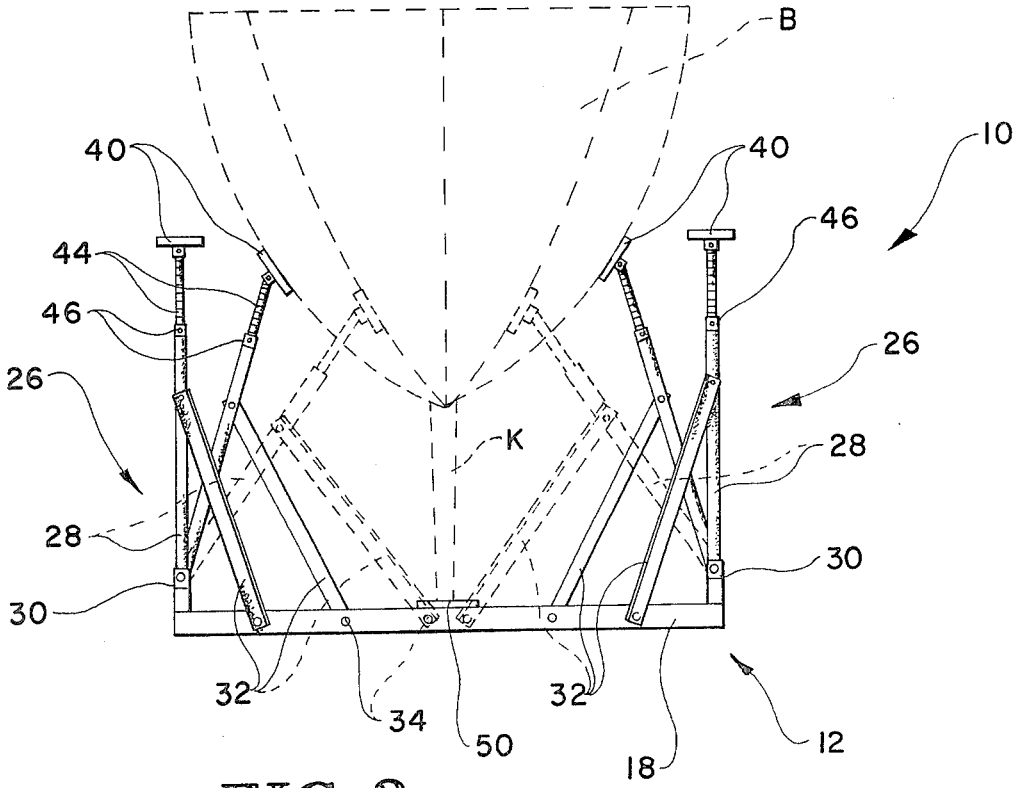
FIG. 2 is an end elevational view of the cradle type boat support system of the present invention with the dotted lines generally illustrating a boat in simple cross section being supported by the same.
Figure 3:
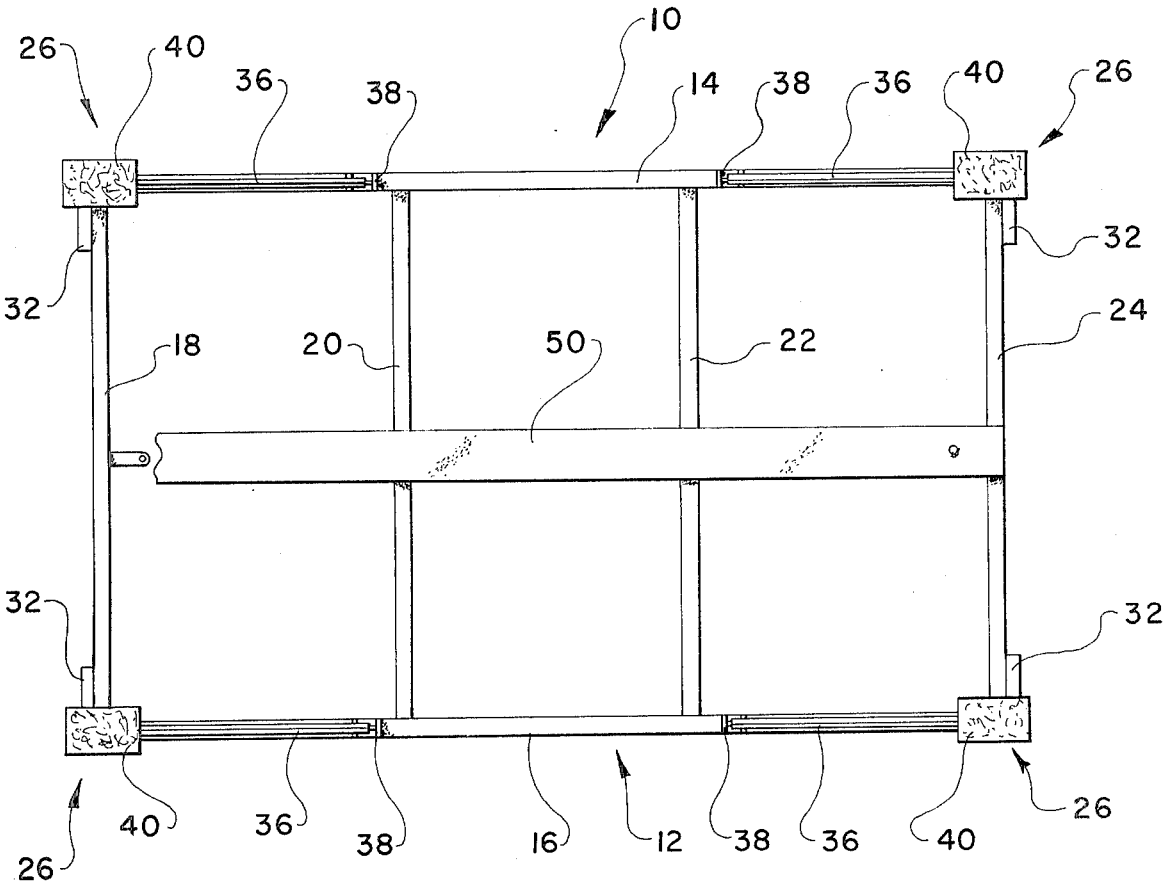
FIG. 3 is a plan view of the cradle type boat support system of the present invention.
Figure 4:
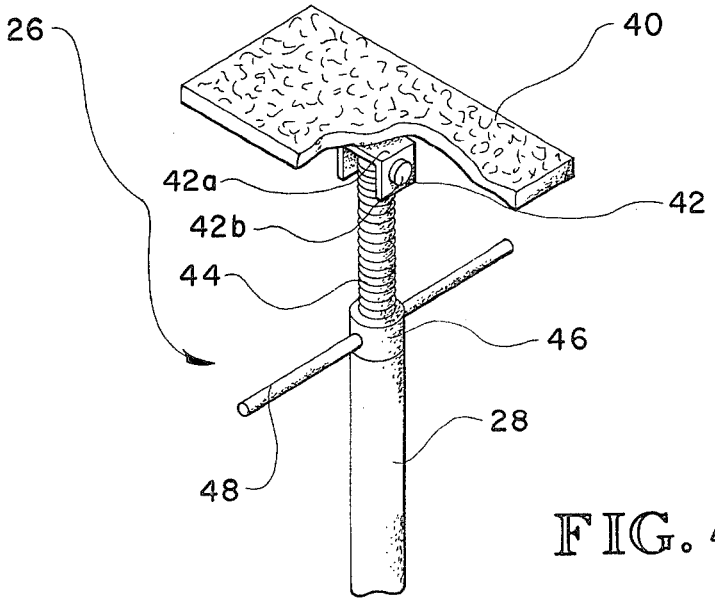
FIG. 4 is a fragmentary perspective view of an upper portion of a vertical support assembly forming a part of the cradle type boat support system of the present invention.

As illustrated in FIG. 4, this means that the principal weight of the boat B as indicated in dotted lines in FIG. 2, is supported through the keel K by the keel support 50.

The respective vertical support assemblies are inclined and directed generally inwardly to engage the side portion of the boat's hull. Consequently, the function of the vertical support assemblies 26 can be said to be one of stabilizing the boat and its hull such that it does not tilt over from one side or tilt either fore or aftly.

It is appreciated that the cradle type boat support system 10 indicated in the drawings herein can be utilized to support boats in a parking lot, over payment, on the ground or any other type of support surface. In addition the same cradle type boat support system 10 can actually be disposed on a trailer or load bed to act as the direct supporting device for a boat that is being transported by such trailer or load bed.

Finally it is appreciated that when not in use the respective vertical support assemblies 26 can be folded down to a position where the respective components thereof lie adjacent the base frame structure 12. This is simply done by removing pin connections between transverse members 18 and 24 and the stabilizer 32. This allows the entire cradle type boat support system to be stacked one on the other and allows them to be transferred and/or stored in such a stacked fashion.

It is appreciated from the foregoing specification that the cradle type boat support system of the present invention has substantial advantages over conventional boat support systems. In this regard, the fact that the cradle type boat support system of the present invention is designed to be compatible with and to accommodate hulls of various sizes and shapes is a significant utility feature. Furthermore, the basic design of the boat support system of the present invention is relatively simple, and this allows the same to be easily and conveniently handled and used.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An adjustable boat cradle for stabilizing and supporting boats having hulls of various size and shape, comprising:

A. a base frame structure including two spaced apart longitudinal frame members and a plurality of transverse frame members extending between said longitudinal frame members so as to define four corner areas and wherein said plurality of transverse frame members includes a pair of end-transverse frame members extending between said longitudinal frame members;

B. a plurality of upstanding vertical support assemblies secured at each corner area of said base frame structure and adapted to extend generally upwardly therefrom to engage, stabilize and generally support a boat hull, each vertical support assembly including:

(1.) a generally elongated main support member operatively connected to said base frame structure at a corner area thereof in the vicinity of a respective junction formed by a respective end-transverse member and a longitudinal frame member and extending upwardly therefrom;

(2.) means for movably mounting said main support member to said base frame structure such that said main frame structure may be inclined at various angles relative to said base frame structure to appropriately engage, stabilize and generally support the hull of a boat;

(3.) a pair of adjustable longitudinal and lateral stabilizing and support members operatively interconnected between said main support member and said base frame structure for stabilizing said main support member at each corner area on said base frame structure, and wherein said stabilizing members include first and second stabilizing members with one stabilizing member being a longitudinal stabilizing member that is operatively interconnected between an adjacent longitudinal frame member and said main support member, while the other stabilizing member is a lateral support member and is operatively interconnected between said main support member and an adjacent end-transverse frame member of said base frame structure;

(4.) means operatively associated with said lateral stabilizing members and said base frame structure for adjusting and varying the anchor point of said lateral stabilizing members relative to said base frame structure in order that the orientation of said main support member can be appropriately varied relative to said main frame structure to accommodate the shape and size of a boat hull, said means for varying the anchor points of respective lateral stabilizing members including a plurality of lateral spaced opening formed in each end-transverse member for allowing each lateral stabilizing member to be anchored at a selected opening;

(5.) means for pivotably connecting each longitudinal stabilizing member to a respective longitudinal frame member of said base structure for enabling said longitudinal stabilizing member to pivot with respect to said base frame structure and to generally swing laterally back and forth in response to the anchor point of said lateral stabilizing member being varied, said means for pivotably connecting each longitudinal stabilizing member to a respective longitudinal frame member including a pivot pin fixed to said longitudinal frame member and extending generally parallel therewith, and wherein each longitudinal stabilizing member includes a lower end portion provided with an opening formed therein and wherein said pivot pin extends through said opening within said longitudinal stabilizing member so as to secure the same to said base frame structure and to allow said longitudinal stabilizing member to pivot thereabout;

(6.) means operatively connected to the upper ends of said main support member for engaging the hull of a boat such that the respective vertical support assemblies cooperate to stabilize and generally support the boat about said base frame structure, said means operatively connected to the upper end of said main support member for engaging and stabilizing the boat hull including an upper cradle pad and an interconnecting member operatively interconnected between said cradle pad and said main support member, and means operatively associated with said interconnecting member for adjusting the effective length thereof with respect to said main support member so as to effectively adjust the height of said cradle pad; said interconnecting member extending between said cradle pad and said main support member including a threaded portion and wherein a portion of said interconnecting member extends into an open area formed within said main support member; and wherein there is provided a threaded nut type member disposed about said threaded interconnecting member and which is adapted to rest about a top portion of said main support member such that the effective length of said interconnecting member extending outwardly from the main support member can be adjusted by turning said threaded member; movable mounting means for movably mounting said cradle pad to said interconnecting member extending between said cradle pad and said main support member such that said cradle pad can conveniently assume an orientation generally flush with the hull of the boat being stabilized and engaged; and C. keel support means normally disposed about said base frame structure and supported thereby for underlying and supporting the keel of said boat while said vertical support assemblies cooperate to engage and stabilize said boat.

2. The adjustable boat support cradle of claim 1 wherein said base frame structure is generally rectangular with said transverse frame members being connected to said longitudinal frame members at generally right angles.

3. The adjustable boat support cradle of claim 2 wherein said end-transverse members of said rectangular base frame structure are disposed below said longitudinal members in order to facilitate gripping and lifting of said adjustable boat cradle from the ground or other support surface.

4. The adjustable boat support cradle of claim 2 wherein selected transverse members of said base frame structure are disposed generally below said longitudinal members.

* * * * *